United States Patent [19]

Hensgen et al.

[11] Patent Number: 4,860,772

[45] Date of Patent: Aug. 29, 1989

[54] METHOD OF AND APPARATUS FOR MAKING A ROD OF FIBROUS MATERIAL

[75] Inventors: Gerhard Hensgen; Uwe Heitmann; Peter Brand, all of Hamburg; Peter Pinck, Gross-Hansdorf, all of Fed. Rep. of Germany

[73] Assignee: Körber AG, Hamburg, Fed. Rep. of Germany

[21] Appl. No.: 199,112

[22] Filed: May 26, 1988

[30] Foreign Application Priority Data

May 29, 1987 [DE] Fed. Rep. of Germany ..... 3718176

[51] Int. Cl.[4] ..... A24C 5/14

[52] U.S. Cl. ..... 131/84.1; 131/84.3; 131/84.4; 131/904; 131/905; 131/906

[58] Field of Search ..... 131/84.1, 84.3, 84.4, 131/904, 905, 906, 907, 908

[56] References Cited

U.S. PATENT DOCUMENTS

| | | | |
|---|---|---|---|
| 4,063,563 | 12/1977 | Lorenzen . | |
| 4,190,061 | 2/1980 | Heitmann et al. . | |
| 4,236,534 | 12/1980 | Heitmann et al. . | |
| 4,280,516 | 7/1981 | Reuland | 131/84.4 |
| 4,284,087 | 8/1981 | Reuland | 131/906 X |
| 4,556,071 | 12/1985 | Hoffmann | 131/84.4 |
| 4,697,603 | 10/1987 | Steinhauer et al. | 131/84.4 |
| 4,697,603 | 10/1987 | Steinhauer et al. . | |
| 4,785,830 | 11/1988 | Möller et al. | 131/84.1 |

FOREIGN PATENT DOCUMENTS 2179444 7/1986 United Kingdom .

*Primary Examiner*—V. Millin
*Assistant Examiner*—Joe H. Cheng
*Attorney, Agent, or Firm*—Peter K. Kontler

[57] ABSTRACT

A shower of fibrous material is directed against the underside of the lower reach of a foraminous endless belt conveyor so that the fibrous material gathers into a continuous stream which is attracted to the conveyor by suction and is moved longitudinally past a trimming device which removes the surplus. The density of the stream is monitored upstream and downstream of the trimming device, and the corresponding signals are processed in an evaluating circuit into additional signals which are indicative of the quantity of the removed surplus. The removed surplus is weighed and the weighing device generates signals also denoting the quantity of the surplus. Such signals are compared with the additional signals and further signals, which denote the differences between the intensities of the compared signals, are used to modify signals denoting the density of the stream downstream of the trimming device. The thus modified signals are used to adjust the trimming device. This ensures that, if the density monitoring operation is carried out by detectors employing sources of infrared light, signals which are generated by such detectors are not affected by certain variable parameters of the fibrous material, such as by the color of tobacco shreds.

19 Claims, 1 Drawing Sheet

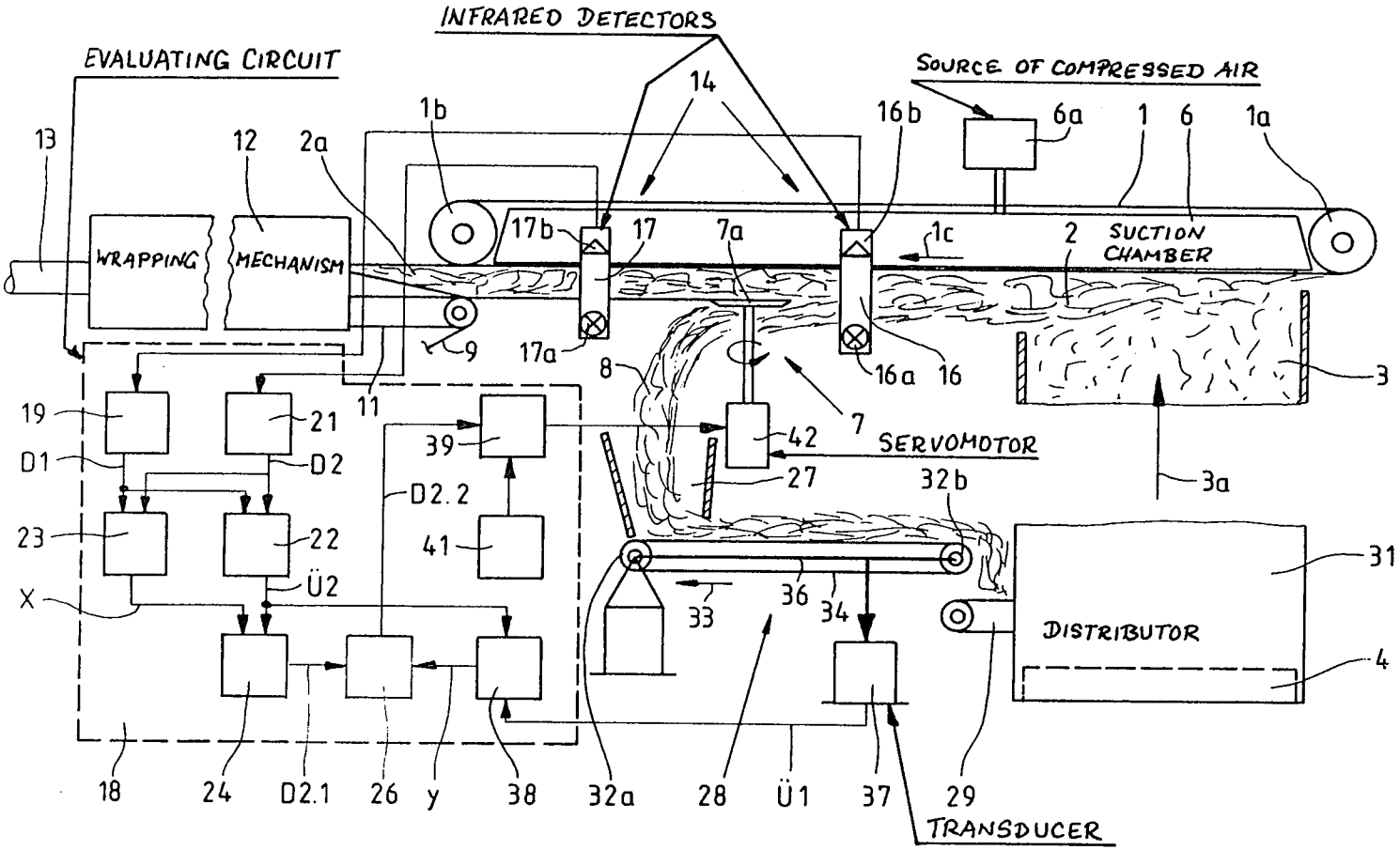
SOURCE OF COMPRESSED AIR
SUCTION CHAMBER
DISTRIBUTOR
SERVOMOTOR
TRANSDUCER
INFRARED DETECTORS
EVALUATING CIRCUIT
MECHANISM
WRAPPING
D2.2
D2
D1
D2.1
Ü1
Ü2
X
y

METHOD OF AND APPARATUS FOR MAKING A ROD OF FIBROUS MATERIAL

BACKGROUND OF THE INVENTION

The invention relates to improvements in apparatus for and in methods of making a rod of fibrous material. More particularly, the invention relates to improvements in a method of and in an apparatus for making a continuous rod of fibrous material from a stream which is obtained by showering fibrous material into a first portion of an elongated path and the stream is conveyed past a trimming device which removes the surplus of fibrous material to thus convert the stream into a rod-like filler which is ready to be draped in a web of cigarette paper or other suitable wrapping material to form therewith a rod which is ready to be subdivided into plain cigarettes, cigars, cigarillos or filter rod sections of desired length.

It is well known to monitor the density of a tobacco stream and to utilize the thus obtained signals for adjustment of the trimming device when the signals indicate that the density of the stream is excessive or too low. As a rule, the density monitoring means comprises a source of corpuscular radiation which is caused to penetrate into successive increments of the trimmed or equalized stream, especially into successive increments of the draped filler, and an ionization chamber or another suitable transducer which ascertains the quantity of radiation that has penetrated across the stream and is indicative of the density of the corresponding increments of the stream. Such monitoring means are quite reliable because their measurements are not influenced by certain parameters of the fibrous material, such as the color of tobacco shreds. However, since the nuclear monitoring means is remote from the trimming device (as mentioned above, such monitoring means is normally placed adjacent the wrapped filler), the density of the conveyed fibrous material is likely to be influenced by the wrapping mechanism which is located between the trimming device and the monitoring means and/or by other components of a rod making machine which contact and/or otherwise influence the advancing mass of fibrous material intermediate the trimming device and the transducer of the nuclear monitoring means. Moreover, many manufacturers of cigarettes or other rod-shaped articles of the tobacco processing industry are reluctant to employ monitoring means which rely on corpuscular radiation because the presence of such monitoring means necessitates numerous expensive undertakings in order to ensure the safety of attendants.

Certain more recent proposals involve the utilization of density monitoring devices which employ infrared light. Reference may be had to German Offenlegungsschrift No. 36 24 236. An important advantage of density monitoring devices which employ infrared light is that their space requirements are minimal so that such devices can be placed into close or immediate proximity of the trimming device, i.e., their density measurements are not distorted by the wrapping mechanism and/or by any other component parts of the rod making machine. Moreover, such density monitoring devices are less expensive because they do not require any safety measures such as those which are not only necessary but actually prescribed by authorities if the density of the stream is measured by nuclear monitoring means. Therefore, when the density is measured by an infrared monitoring device, the number of rejects (rod-shaped articles which have been separated from the rod, which have undergone a final test for the presence of defects including unsatisfactory density of their fillers, and which have been found to be defective because the density of their fillers is excessive or too low) is minimal. This will be readily appreciated since the density is monitored immediately adjacent the locus of removal of the surplus from the moving stream, and the results of such measurements can be used to adjust the trimming device if the monitored density deviates from the desired optimum density.

A drawback of infrared density monitoring devices is that the accuracy of their measurements is dependent upon certain parameters, such as the color of fibrous material which forms the stream. Thus, the intensity or other characteristics of signals which are transmitted by the transducers of infrared monitoring devices are likely to change if the color of the conveyed material has changed, even though the density of the conveyed material does not change at all. Attempts to overcome such drawbacks of infrared density monitoring devices include simultaneous utilization of such devices with nuclear density monitoring means. Signals from the ionization chamber of the nuclear density monitoring means are used to test the signals which are furnished by the transducer of an infrared monitoring device to thus ensure that adequate measures can be undertaken when the characteristics of signals which are transmitted by the transducer of the infrared monitoring device deviate from the normally more reliable signals from the ionization chamber of the nuclear density monitoring means. Such apparatus are quite satisfactory; however, their cost is high because of the need for simultaneous monitoring of the density by a nuclear monitoring means and by an infrared density monitoring device. In addition, it is necessary to carry out all safety measures which are prescribed when one employs monitoring means operating with corpuscular radiation in spite of the fact that the safety provisions are or can be somewhat less stringent because the nuclear density monitoring means can employ a relatively weak source of corpuscular radiation.

OBJECTS AND SUMMARY OF THE INVENTION

An object of the invention is to provide a method which ensures rapid, accurate and reliable determination of density of the removed surplus of fibrous material without resorting to nuclear density monitoring means.

Another object of the invention is to provide a novel and improved method of ascertaining the density of successive increments of a stream of fibrous material in a number of different ways.

A further object of the invention is to provide a method which renders it possible to accurately monitor the density of successive increments of a stream of fibrous material by non-nuclear density monitoring means even if the color or certain other parameters of the material of the stream vary at random.

An additional object of the invention is to provide a method which can be used with advantage to regulate the density of a stream of fibrous material for the making of rod-shaped articles of the tobacco processing industry.

Still another object of the invention is to provide a novel and improved apparatus for the practice of the above outlined method.

A further object of the invention is to provide the apparatus with novel and improved means for ascertaining the density of successive increments of a continuous stream of fibrous material in a number of different ways, and with novel, improved, simple, compact and inexpensive means for processing the results of such measurements in order to permit immediate alterations of the density when the monitored density deviates from a desired optimum density.

An additional object of the invention is to provide a novel and improved rod making machine which embodies the above outlined apparatus.

Another object of the invention is provide an apparatus which can reliably determine the density of successive increments of a moving stream of fibrous material of the tobacco processing industry without resorting to nuclear density monitoring means.

A further object of the invention is to provide the apparatus with a novel and improved signal evaluating arrangement.

Another object of the invention is to provide the apparatus with novel and improved means for practically instantaneously changing the density of the stream if the monitored density deviates from the desired optimum density.

One feature of the present invention resides in the provision of a method of forming a rod of fibrous material, e.g., a rod of natural, reconstituted or artificial tobacco or filter material for tobacco smoke. The method comprises the steps of gathering fibrous material into a continuous surplus-containing stream and advancing the stream in a predetermined direction along a predetermined path (such as along the underside of the lower reach of an endless air-permeable belt conveyor), monitoring the density of the stream including generating first signals which denote the monitored density, removing the surplus from the stream in a predetermined portion of the path, and measuring the quantity of the removed surplus including generating a series of second signals denoting the measured quantity of the removed surplus.

The method preferably further comprises the step of thereafter modifying at least some of the first signals as a function of the second signals.

The monitoring step can include ascertaining the density of successive increments of the stream upstream of the predetermined portion of the path and generating a first series of first signals, ascertaining the density of successive increments of the stream downstream of the predetermined portion of the path and generating a second series of first signals, and processing the first signals of the first series and the corresponding first signals of the second series into a series of additional signals denoting the quantity of the surplus which is removed from the respective increments of the stream. Such method can further comprise the step of regulating the surplus removing step as a function of the first signals of one of the first and second series of first signals. More specifically, such method can include the steps of comparing the second signals with the additional signals and generating further signals which are indicative of differences between the second signals and the additional signals, and modifying the first signals of one of the first and second series of first signals as a function of the further signals. Such method preferably comprises the step of regulating the surplus removing step as a function of the second signals of the second series.

At least one of the aforementioned ascertaining steps can include directing at least one beam of light against the stream and determining the extent of penetration of light through the stream. Such light is or can be infrared light.

The measuring step can include continuously weighing the removed surplus.

The removed surplus can be returned to the main source of fibrous material for readmission into the predetermined path.

Another feature of the invention resides in the provision of an apparatus for forming a rod of fibrous material, such as a cigarette rod, a cigar rod, a cigarillo rod or a filter rod. The apparatus can form part of a continuous rod making machine (such as a cigarette maker or a filter rod making machine) and comprises a conveyor which defines an elongated path, means (such as a duct) for supplying fibrous material into a first portion of the path so that the supplied material forms a stream which contains a surplus of fibrous material and advances along the path in a predetermined direction, means for removing the surplus from the stream in a second portion of the path downstream of the first portion, means for monitoring the density of the stream including means for generating first signals which denote the monitored density of the stream, and means for measuring the removed surplus including means for generating second signals which denote the quantity of the removed surplus. The apparatus further comprises signal evaluating means including means for converting the second signals into further signals and means for modifying at least some of the first signals as a function of such further signals.

The monitoring means can include first and second detector means for respectively ascertaining the density of successive increments of the stream upstream and downstream of the second portion of the path, and for respectively generating a first and a second series of first signals. The evaluating means can comprise means for converting the first signals of the first series and the corresponding first signals of the second series of first signals into a series of additional signals denoting the quantity of the surplus which is removed from the respective increments of the stream. The modifying means converts the second signals and the additional signals into the aforementioned further signals.

The surplus removing means is or can be adjustable, and the apparatus can further comprise means for adjusting the surplus removing means as a function of the first signals of one of the first and second series of first signals. The one series is preferably the second series of first signals, i.e., that series whose signals are modified as a function of the further signals. Thus, the evaluating means can comprise the aforementioned means for converting the second signals and the additional signals into further signals, and means for modifying the first signals of the second series as a function of further signals and for transmitting the modified first signals of the second series to the adjusting means for the surplus removing means.

The monitoring means can further comprise means for directing light against the stream, and the means for generating first signals then includes means for determining the extent of penetration of light across the stream. The light directing means can include at least one source of infrared light.

The measuring means can include means for weighing the removed surplus, either directly or indirectly (such as by a belt weigher or by a yieldable impact plate).

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWINGS

The single FIGURE of the drawing is a schematic elevational view of an apparatus which forms part of a cigarette rod making machine and embodies one form of the invention, the density monitoring means of the illustrated apparatus having two infrared density detectors one of which monitors the density of the unequalized stream of fibrous material ahead of and the other of which monitors the density of the equalized stream downstream of the surplus removing station.

DESCRIPTION OF PREFERRED EMBODIMENTS

The single FIGURE of the drawing shows a portion of a cigarette rod making machine including an apparatus which converts a shower of fibrous material (such as shreds of tobacco leaf laminae and/or fragments of tobacco ribs) into a continuous stream 2 of such material, and which ensures that the density of successive increments of the stream matches or closely approximates an optimum value not later than when such increments are ready to be draped into a web 9 of cigarette paper or other suitable wrapping material. Only those parts of the cigarette rod making machine which are necessary for full understanding of the invention are shown in the drawing.

The improved apparatus comprises an endless air-permeable belt conveyor 1 which is trained over pulleys 1*a*, 1*b* at least one of which is driven so that the lower reach of the conveyor advances in the direction which is indicated by an arrow 1*c*. This lower reach defines an elongated path for the stream 2 which is formed by showering particles of fibrous material into a first portion of the path, namely, into the portion above the open upper end of a duct 3 wherein the shower of fibrous material ascends in the direction of arrow 3*a*. The references character 31 denotes a customary distributor (also called hopper) containing a driven roller 4 which causes the shower of fibrous material to rise in the direction of arrow 3*a* and to deposit at the underside of the lower reach of the conveyor 1. The stream 2 is attracted to the lower reach of the conveyor 1 by a suction chamber 6 which is adjacent the upper side of the lower reach and has at least one outlet connected with a suitable suction generating device 6*a*, e.g., a pump or a fan.

The unequalized stream 2 advances from the first portion toward and through a second portion of the elongated path wherein an adjustable or regulatable trimming or equalizing device 7 removes the surplus 8 so that the thus trimmed or equalized stream 2*a* constitutes a rod-like filler which is ready for conversion into the filler of a continuous cigarette rod 13, namely for draping into the web 9 of cigarette paper or the like in a conventional wrapping mechanism 12 wherein the web 9 is converted into a tube surrounding the filler 2*a*. The means for conveying the web 9 and the filler 2*a* through the wrapping mechanism 12 comprises an endless belt conveyor 11 known as garniture. The resulting rod 13 is then subdivided into sections of desired length, and such sections constitute plain cigarettes which are ready for packing, for admission into a reservoir or for admission into a filter tipping machine wherein plain cigarettes and filter rod sections are assembled into filter cigarettes in a manner not forming part of the present invention.

The trimming device 7 includes one or more rotary trimming discs 7*a* which are disposed at a variable distance from the lower reach of the conveyor 1. By changing the distance of the disc or discs 7*a* from the lower reach of the conveyor 1, the improved apparatus can change the quantity of the removed surplus 8 and hence the density of the fibrous filler in the tubular envelope of the cigarette rod 13.

In accordance with a feature of the invention, the apparatus comprises a device 14 which monitors the density of successive increments of the untrimmed stream 2 ahead of the trimming device 7 and the density of successive increments of the trimmed stream (filler) 2*a* downstream of the trimming device 7. The monitoring device 14 comprises a first infrared detector 16 which ascertains the density of successive increments of the filler 2*a*. The detector 16 comprises a source 16*a* of infrared light which directs at least one beam of such radiation against successive increments of the stream 2 so that a certain amount of radiation penetrates through the stream 2, and a photoelectronic transducer 16*b* which determines the quantity of radiation that has penetrated through successive increments of the stream 2 and generates first signals which are indicative of the density of the respective increments of the stream 2. The construction of the detector 17 is analogous; it comprises a source 17*a* infrared light which directs such radiation against successive increments of the filler 2*a* immediately or closely downstream of the trimming disc or discs 7*a*, and a transducer 17*b* which generates first signals denoting the density of successive increments of the filler 2*a*.

The outputs of the transducers 16*b*, 17*b* are connected to the corresponding inputs of an evaluating circuit 18 which is constructed and operates in accordance with another feature of the present invention. More specifically, the output of the transducer 16*b* transmits signals to a circuit 19 which amplifies and/or otherwise processes the incoming signals and transmit a first series of first signal D1 each of which is indicative of the density of the respective increment of the untrimmed stream 2. Analogously, the output of the transducer 17*b* transmits signals to a circuit 21 which amplifies and/or otherwise modifies the incoming signals and transmits a second series of first signals D2 each of which is indicative of the density of the respective increment of the trimmed stream or filler 2*a*.

The outputs of the circuits 19, 21 are connected with the corresponding inputs of a signal converting or processing circuit 22 which converts the signals D1 and the corresponding signals D2 into additional signals Ü2 each of which is indicative of the difference of intensities and/or other matching characteristics of the respective first signals D1 and D2 and hence of the quantity of removed surplus 8. The outputs of the circuits 19, 21 are further connected with the corresponding inputs of a quotient forming circuit 23 which transmits a series of comparison signals X each denoting the quotient of the respective first signals D1 and D2.

The circuits 22 and 23 transmit the respective signals Ü2 and X to the corresponding inputs of a processing circuit 24 which transmits density signals D2.1 to the corresponding input of a signal modifying circuit 26 another input of which receives further signals Y from a signal comparing circuit 38. The output of the signal modifying circuit 26 transmits signals to an adjusting or regulating circuit 39 which controls a servomotor 42 constituting a means for changing the distance of the trimming disc or discs *7a* from the lower reach of the conveyor 1, i.e., for actually adjusting or regulating the density of the filler *2a* and hence the density of the filler of the cigarette rod 13.

The surplus 8 which is removed by the disc or discs *7a* of the trimming device 7 descends into a funnel-shaped gravity duct 27 and comes to rest on the upper reach of an endless belt conveyor 34 forming part of a surplus measuring device 28 here shown as a belt weigher. The conveyor 34 is trained over pulleys 32*a*, 32*b* which are mounted on an elongated weighbeam 36. The latter is pivotable in the frame of the cigarette rod making machine about the axis of the pulley 32*a* (which is driven in any suitable manner, not shown in the drawing to move the conveyor 34 in the direction of arrow 33). The weight of the removed surplus 8 on the upper reach of the conveyor 34 determines the magnitude of the force with which the weighbeam 36 bears upon a transducer 37 serving to generate a series of (second) signals Ü2 which are indicative of the quantity of surplus 8 which is removed from successive increments of the stream 2. The discharge end of the conveyor 34 (in the region of the pulley 32*b*) delivers the surplus to a further endless belt conveyor 29 which returns the surplus into the distributor 31 so that the fibrous material of the thus returned surplus can be reintroduced into the first portion of the path which is defined by the lower reach of the conveyor 1.

Successive signals Ü1 of the series of (second) signals which are generated by the transducer 37 are transmitted to the corresponding input of the comparing circuit 38 which converts such signals and the corresponding additional signals Ü2 (from the dividing circuit 22) into the aforementioned further signals Y for transmission to the signal modifying circuit 26 which influences the signals D2.1 and converts them into signals D2.2 which are transmitted to the adjusting or regulating circuit 39 for the servomotor 42.

The adjusting circuit 39 compares successive signals D2.2 with a reference signal which is furnished by a potentiometer 41 or another suitable source of signals denoting the desired optimum value of density of successive increments of the filler *2a*.

As mentioned above, the detector 17 is placed into close or immediate proximity of the trimming disc or discs *7a* downstream of the trimming device 7 so that it can ascertain the density of successive increments of the filler *2a* before the density of such increments can be influenced by other parts of the apparatus. This ensures that the apparatus can change the level of the disc or discs *7a* in practically instantaneous response to any deviation of monitored density of signals D2.2 (modified first signals of the (second) series furnished by the detector 17) from the desired density which is indicated by the signal from the source 41 of reference signals.

Another important advantage of the improved method and apparatus is that the quantity of the surplus 8 is measured twice, namely directly by the weighing device 28 and its transducer 37 (second signals Ü1), and indirectly by the evaluating circuit 18 (additional signals Ü2). Since the (further) signals Y are obtained on the basis of a comparison of the corresponding signals Ü1 and Ü2, and since the signals Y influence the signals (D2.2) which are used to effect an adjustment of the level of the trimming disc or discs *7a* via comparator circuit 39 and servomotor 42, the improved apparatus reliably eliminates the undesirable influence upon the signals D2 of those parameters of the stream 2, filler *2a* and/or detectors 16, 17 which could cause the infrared detectors 16, 17 to furnish misleading density signals, particularly as a result of changes of the color of fibrous material which forms the stream 2.

A further important advantage of the improved method and apparatus is that nuclear density monitoring means are no longer necessary. This contributes to lower cost and enhances the safety of the apparatus.

Since the weighing device 28 generates (second) signals (Ü1) denoting the quantity of fibrous material in successive increments of the removed flow of surplus 8, and since the signals Ü1 are used to influence the signals D2, the improved apparatus effectively eliminates the undesirable influence of long-range deviations of density of the stream 2 and filler *2a* from a desired optimum density. Such long-range deviations could develop as a result of changes of the blend of two or more types of fibrous material which form the stream 2 and/or as a result of changes of characteristics of the detector 16 and/or 17, for example, as a result of temperature changes. Thus, the weighing device 28 can be said to constitute a means for reliably calibrating the monitoring device 14 so as to even further reduce the need for nuclear density monitoring means by enhancing the accuracy and reliability of the illustrated monitoring device 14.

It will be noted that the improved evaluating circuit 18 modifies the second series of first signals (D2), namely that series of signals which are generated by the detector 17 to denote the density of the filler *2a* immediately downstream of the trimming device 7. This is desirable and advantageous because the signals D2 are especially suited to ensure immediate changes of the level of the trimming device 7 when the monitored density of the filler *2a* departs from the desired optimum density as denoted by the signal from the source 41 of reference signals. Modifications of signals D2 on their way to the adjusting or regulating circuit 39 are desirable and advantageous because they eliminate the undesirable influence of the aforediscussed parameters, such as variations of the color of fibrous material, changes of temperature of the detector 17 and/or others.

The belt weigher 28 constitutes but one of several suitable means for weighing the removed surplus 8, i.e., for directly ascertaining the quantity of the removed surplus. For example, the illustrated belt weigher can be replaced with a so-called impact plate (not specifically shown) which is analogous to the weighbeam 36 in that it can be located in the path of the removed surplus 8 and can be caused to change its orientation to an extent which is a function of the quantity of the removed surplus. The extent of deflection or change of orientation of the impact plate is monitored, and the resulting signals correspond to the (second) signals Ü1. If desired or necessary, successive increments of the removed surplus 8 can be propelled against the pivotably or otherwise movably mounted impact plate.

The illustrated evaluating circuit 18 of the improved apparatus is shown in the form of a set of discrete circuits (19, 21–24, 26, 38, 39, 41). In a modern cigarette rod making or like machine, the evaluating circuit 18 can form part of the central processor in a computer so that one cannot speak of a discrete signal comparing, modifying, dividing or other circuits. Thus, the blocks of the illustrated evaluating circuit 18 can be interpreted as functional blocks denoting the operation of a microcomputer and being shown individually solely in an effort to facilitate an understanding of the manner of processing the first signals D1, D2 and the second signals U1.

The detector 16 and/or 17 can employ one or more other sources of noncorpuscular radiation without departing from the spirit of the invention. For example, the infrared radiation source 16*a* and/or 17*a* can be replaced with one or more sources of visible light.

An apparatus with a monitoring device having two infrared detectors, one ahead of and one behind the surplus removing means, is disclosed in commonly owned copending U.S. patent application Ser. No. 152,951 filed Feb. 5, 1988 by Wolfgang Siems for "Method of and apparatus for making a rod of fibrous material". The apparatus of Siems does not employ a device for directly weighing the removed surplus of fibrous material.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A method of forming a rod of fibrous material, comprising the steps of gathering fibrous material into a continuous surplus containing stream and advancing the stream in a predetermined direction along a predetermined path; monitoring the density of the stream including generating first signals denoting the monitored density; removing the surplus from the stream in a predetermined portion of said path; measuring the quantity of the removed surplus including generating a series of second signals denoting such quantity; modifying said first signals as a function of said second signals; and utilizing said modified first signals to influence when necessary the density of the rod.

2. The method of claim 1, wherein said monitoring step includes ascertaining the density of successive increments of the stream upstream of the predetermined portion and generating a first series of first signals, ascertaining the density of successive increments of the stream downstream of the predetermined portion and generating a second series of first signals, and processing the signals of said first series and the corresponding signals of said second series into a series of additional signals denoting the quantity of surplus which is removed from the respective increments of the stream.

3. The method of claim 2, within said utilizing step comprises regulating said surplus removing step as a function of the first signals of one of said first and second series of first signals.

4. The method of claim 2, further comprising the step of comparing said second signals with said additional signals and generating further signals which are indicative of the differences between said second and additional signals, said modifying step comprising modifying the first signals of one of said first and second series of first signals as a function of said further signals.

5. The method of claim 4, within said utilizing step comprises regulating said surplus removing step as a function of the first signals of said second series.

6. The method of claim 4, wherein said one of said first and second series of first signals is said second series of first signals.

7. The method of claim 2, wherein at least one of said ascertaining steps includes directing at least one beam of light against the stream and determining the extent of penetration of light through the stream.

8. The method of claim 7, wherein said light is infrared light.

9. The method of claim 1, wherein said measuring step includes continuously weighing the removed surplus.

10. Apparatus for forming a rod of fibrous material, comprising an elongated conveyor defining an elongated path; means for supplying fibrous material into a first portion of said path so that the supplied material forms a stream which contains a surplus of fibrous material and advances in a predetermined direction along said path; means for removing the surplus from the stream in a second portion downstream of the first portion of said path; means for monitoring the density of the stream, including means for generating first signals denoting the monitored density; means for measuring the removed surplus, including means for generating second signals denoting the quantity of removed surplus; and means for modifying said first signals as a function of said second signals, said removing means including means for influencing when necessary the density of the rod as a function of said modified first signals.

11. The apparatus of claim 10, further comprising signal evaluating means including means for converting said second signals and first signals into further signals, said modifying means including means for modifying said first signals as a function of said further signals.

12. The apparatus of claim 10, wherein said monitoring means includes first and second detector means for ascertaining the density of successive increments of the stream upstream of and downstream of the second portion of said path, respectively, and for respectively generating a first and a second series of first signals, and further comprising signal evaluating means including means for converting the first signals of said first series and the corresponding first signals of said second series into a series of additional signals denoting the quantity of the surplus which is removed from the respective increments of the stream.

13. The apparatus of claim 12, wherein said evaluating means further comprises means for converting said second signals and said additional signals into further signals, said modifying means including means for modifying the first signals of at least one of said first and second series of first signals as a function of said further signals.

14. The apparatus of claim 12, wherein said removing means is adjustable, and further comprising means for adjusting said removing means as a function of the first signals of one of said first and second series.

15. The apparatus of claim 14, wherein said one of said first and second series of first signals is said second series of first signals.

16. The apparatus of claim 15, wherein said evaluating means further comprises means for converting said second signals and said additional signals into further signals said modifying means including means for modifying the first signals of said second series as a function of said further signals and for transmitting the modified first signals of the second series to said adjusting means.

17. The apparatus of claim 10, wherein said monitoring means further comprises means for directing light against the stream and the means for generating first signals includes means for determining the extent of penetration of light across the stream.

18. The apparatus of claim 17, wherein means for directing light includes at least one source of infrared light.

19. The apparatus of claim 10, wherein said measuring means includes means for weighing the removed surplus.

* * * * *